US008070347B1

(12) United States Patent
Lin

(10) Patent No.: US 8,070,347 B1
(45) Date of Patent: Dec. 6, 2011

(54) LAMP ASSEMBLY OF LIGHT-EMITTING DIODE STRING LIGHT

(75) Inventor: Hao-Lun Lin, Kaohsiung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 50 days.

(21) Appl. No.: 12/817,896

(22) Filed: Jun. 17, 2010

(51) Int. Cl.
*F21S 4/00* (2006.01)
*H01R 33/00* (2006.01)

(52) U.S. Cl. ..... 362/654; 362/391; 362/656; 439/699.2

(58) Field of Classification Search ..... 362/654, 362/655, 656, 391, 249.02, 249.06; 313/512; 315/185 S; 439/619, 699.2
See application file for complete search history.

(56) References Cited

U.S. PATENT DOCUMENTS 5,526,250 A * 6/1996 Ting et al. ..... 362/391
5,630,729 A * 5/1997 Francis ..... 439/548
6,878,015 B2 * 4/2005 Fan ..... 439/699.2
7,094,111 B1 * 8/2006 Qingbiao ..... 439/699.2
7,241,032 B2 * 7/2007 Qingbiao ..... 362/382

* cited by examiner

*Primary Examiner* — Peggy A. Neils
(74) *Attorney, Agent, or Firm* — patenttm.us

(57) ABSTRACT

A lamp assembly of LED string light has a lamp module, an inner housing, an outer housing, a lower shell and a lamp cover module. The lamp module has a circuit board and an LED bulb and a set of power lines mounted on the circuit board. The inner housing has two symmetrical and engaged inner cases and a space to receive the lamp module. The outer housing has two symmetrical outer cases assembled together and encloses the inner housing. The lower shell is sleeved around a bottom portion of the inner housing. The lower shell has a multi-step portion formed on a periphery thereof for the lamp cover module to sleeve on the lower shell. Given the aforementioned elements, the lamp assembly of LED string light is easily assembled and highly waterproof and dust-proof.

8 Claims, 6 Drawing Sheets

LAMP ASSEMBLY OF LIGHT-EMITTING DIODE STRING LIGHT

BACKGROUND OF THE INVENTION

1. Field of the Invention

The present invention is related to a lamp, and more particularly to a lamp assembly of a light-emitting diode (LED) string light being easily and conveniently assembled and highly waterproof and dustproof.

2. Description of the Related Art

String lights emphasize more as a decorative tool than a lighting tool and are decorated on trees or buildings to create a sense of occasion for special events or festivals. Traditionally, lamps of the string light pertain to small incandescent bulbs. After LED lamp came out to the market, the incandescent bulbs are gradually overwhelmed by the new light source having brighter luminance and longer life cycle. Besides, higher weatherability of LED lamp makes LED a better choice for a light source of the string light mounted outdoors.

Besides the LED light source, an LED lamp of the string light also contains other electrical elements, such as circuit board, power lead and the like. If a housing of the LED lamp is not sufficiently airtight, those electrical elements are easily affected by weather condition.

Furthermore, as the LED string light has a plurality of lamps mutually connected by connection cables and the assembly of the LED string light is conducted manually, how to make the lamp assembly easy and convenient needs to be further explored.

SUMMARY OF THE INVENTION

An objective of the present invention is to provide a lamp assembly of LED string light being easily and conveniently assembled and highly waterproof and dustproof.

To achieve the foregoing objective, the lamp assembly of LED string light has an outer housing, an inner housing, a lamp module, a lower shell and a lamp cover module.

The outer housing being hollow and has an inner wall, two outer cases, two half cases and two half bowls.

The two outer cases are symmetrical and correspondingly assembled. The two half bowls are symmetrical and correspondingly assembled, and each of the two half bowls is formed on a lower portion of the inner wall.

The inner housing is mounted inside the outer housing and hollow, takes a form of a multi-step cylinder and has two inner cases and three half cylindrical portions.

The two inner cases are symmetrical and correspondingly assembled, and each of the two inner cases has an engagement portion formed on an inside border of the inner housing. The three half cylindrical portions are sequentially and downwardly formed on a periphery of each of the inner cases with the respective diameters decreasing downwardly and the lowest half cylindrical portion received in the half bowl of the outer case.

The lamp module is mounted inside the inner housing and has a circuit board, an LED bulb, a connection circuit and a set of power lines.

The LED bulb is formed on a lower end of the circuit board and penetrates through a bottom of the inner housing and a bottom of the two outer cases.

The connection circuit is formed on the circuit board to electronically connect with the LED bulb.

The set of power lines is connected with the connection circuit and sequentially penetrates through the inner housing and the outer housing.

The lower shell has an upper tube and a lower tube. The upper tube is hollow and has an inner diameter matching an outer diameter of the middle half cylindrical portions of the inner housing to sleeve the middle half cylindrical portions therein. The lower tube is hollow and co-axially connected with the upper tube and has an inner diameter matching an outer diameter of the lowest half cylindrical portions of the inner housing to sleeve the lowest cylindrical portions therein and at least one first fastening part formed on a periphery of the lower tube.

The lamp cover module is hollow and has a lamp cover, an opening, a neck and at least one second fastening part. The opening is formed through a top of the lamp cover. The neck is formed to extend upwardly from the opening, and has an inner diameter and an outer diameter respectively matching an outer diameter of the lower tube of the lower shell and an inner diameter of the outer housing. The at least one second fastening part is formed on the neck, and each of the at least one second fastening part matches and engages the corresponding first fastening part.

As the circuit board is the most vulnerable part to the moisture and dust resulting from a weather condition, the circuit board is enclosed by the inner housing, the outer housing and the lower shell, and is further sealed by the guard ring formed on the inner housing, thereby enhancing the weathering resistance for outdoor applications. The engagement portions and the fastening parts further seal the assembly and address a simple means to manually assembly the lamp assembly without requiring any tool.

DETAILED DESCRIPTION OF THE INVENTION

Figure 1:
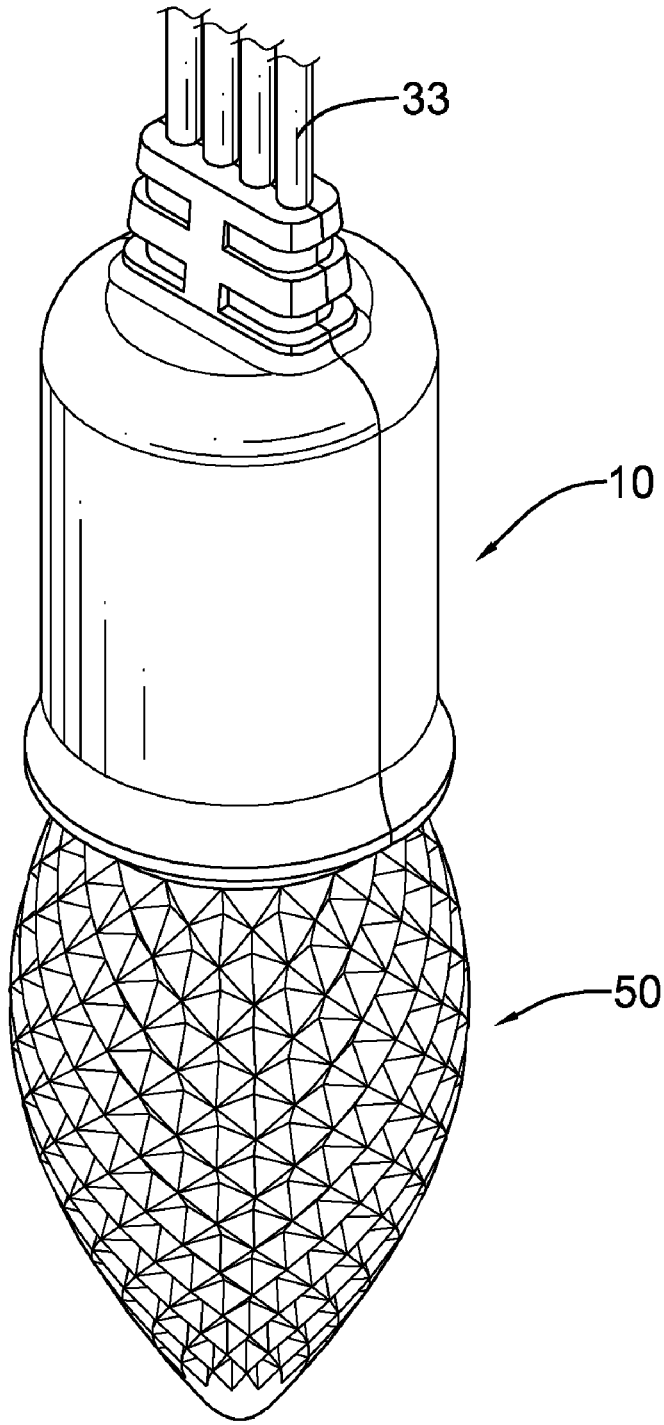
FIG. 1 is a perspective view of a lamp assembly of LED string light in accordance with the present invention.
Figure 2:
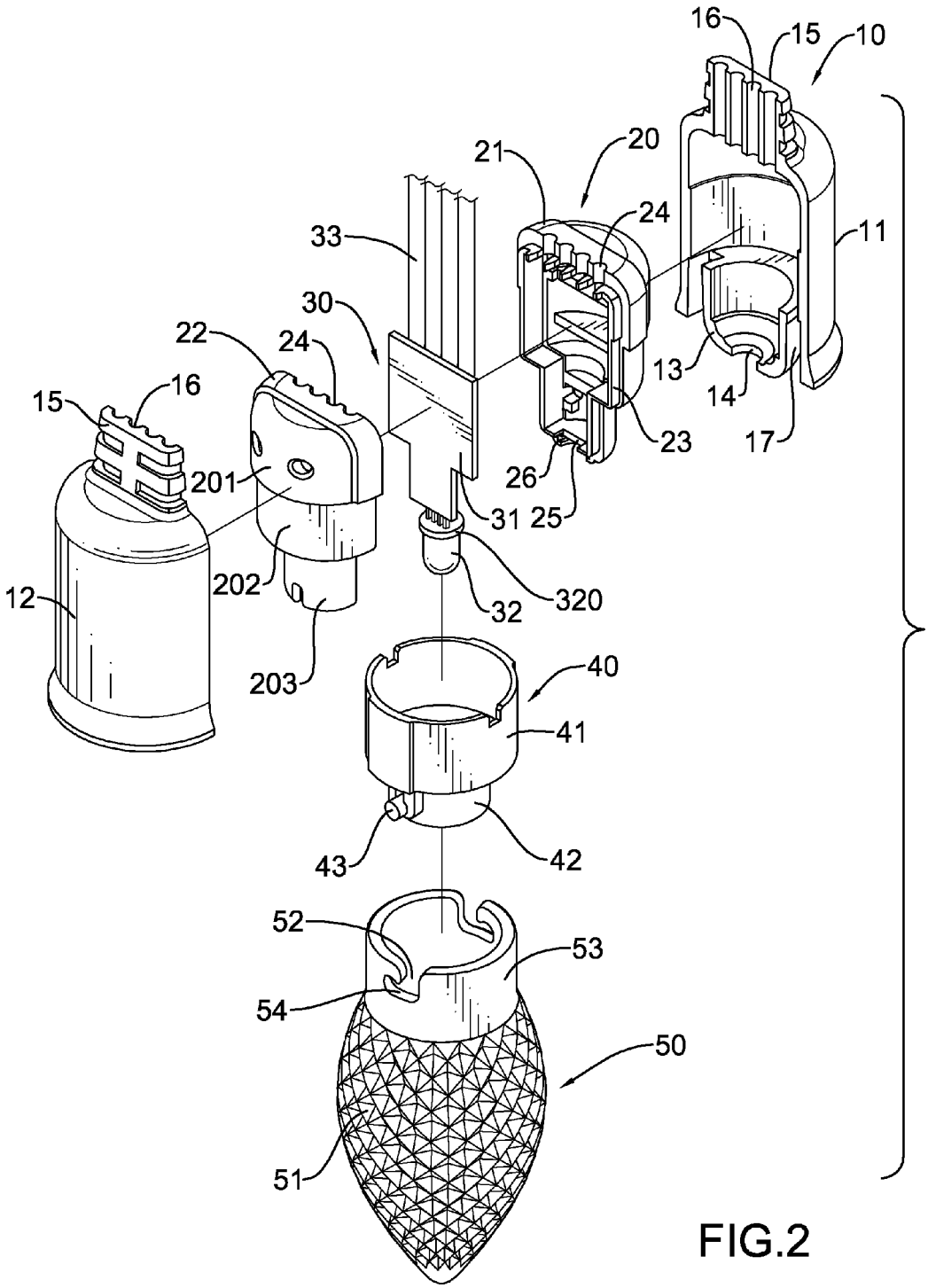
FIG. 2 is an exploded perspective view of the lamp assembly in FIG. 1.

With reference to FIGS. 1 and 2, a lamp assembly of LED string light in accordance with the present invention has an outer housing (10), an inner housing (20), a lamp module (30), a lower shell (40) and a lamp cover module (50).

The outer housing (10) takes a form of a bell and has two symmetrical outer cases (11, 12). Each of the outer cases (11, 12) has a half bowl (13), a half first lamp hole (14) and a half outlet portion (15). The half bowl (13) is formed on a lower portion of an inner wall of each of the outer cases (11, 12). The two half bowls (13) of the outer cases (11, 12) are symmetrical and correspondingly assembled to form a bowl. Two recesses (17) are formed between a periphery of the bowl and the inner wall of the outer cases (11, 12). The half first lamp hole (14) is formed through a bottom of the corresponding half bowl (13), and the two half first lamp holes are correspondingly assembled to constitute a first lamp hole. The two half outlet portions (15) of the outer cases (11, 12) are symmetrical and correspondingly assembled to form an outlet portion. The half outlet portion (15) extends upwardly from an inside portion of a top of each of the outer cases (11, 12). Multiple wire channels (16) are formed in an inner wall of the half outlet portion (15).

The inner housing (20) is composed of two hollow and symmetrical inner cases (21, 22). Each of the inner cases (21, 22) is hollow and mounted inside the outer housing (10), takes a form of a multi-step cylinder, and has three half cylindrical portions (201, 202, 203), an engagement portion, multiple wire channels (24), a half second lamp hole (25) and a half guard ring (26). The three half cylindrical portions (201, 202, 203) are sequentially and downwardly formed on a periphery of each of the inner cases (21, 22) with the respective diameters decreasing downwardly. The lowest half cylindrical portion (203) is received in the half bowl (13) of each of the two outer cases (11, 12). The engagement portions of the two inner cases (21, 22) are respectively formed on inside borders of the two inner cases (21, 22) and mutually match. The matched engagement portions may be a wall (23) formed along the inside border of one of the two inner cases (21, 22) and a groove (not shown) formed in the inside border of the other inner case (22, 21) respectively. The two inner cases (21, 22) are mutually assembled through the engagement portions thereof to form the inner housing (20). The multiple wire channels (16) are formed in a top portion of an inner wall of each of the inner cases (21, 22). The half second lamp hole (25) is formed through a bottom inside the corresponding inner case (21, 22) for a light source of the lamp module (30) to penetrate through. The two half second lamp holes (25) of the two inner cases (21, 22) are symmetrical and correspondingly assembled to form a second lamp hole. The half guard ring (26) is formed on a bottom outside each of the two inner cases (21, 22) and underneath the second lamp hole. The two half guard rings (26) of the two inner cases (21, 22) are symmetrical and correspondingly assembled to form a guard ring.

The lamp module (30) is mounted inside the inner housing (20) and has a circuit board (31), the LED bulb (32), a connection circuit (not shown) and a set of power lines (33). The circuit board (31) takes a T-like form to suit for a space enclosed by the inner cases (21, 22). The LED bulb (32) is formed on a lower end of the circuit board (31) and penetrates through the second lamp hole of the inner cases (21, 22) and the first lamp hole of the bowl to expose beyond the first lamp hole. The LED bulb (32) has an annular loop (320) formed around an outside of the LED bulb (32) and engaging in the guard ring (26) to effectively seal the lamp module (30) inside the inner housing (20). The connection circuit is mounted on the circuit board (31) to electronically connect with the LED bulb (32). The set of power lines (33) of the lamp module (30) is connected with the connection circuit and sequentially penetrates through the wire channels (24) of the inner housing (20) and the wire channels (16) of the outer housing (10) to connect with an external power source.

The lower shell (40) has an upper tube (41) and a lower tube (42). An outer diameter of the upper tube (41) is greater than that of the lower tube (2). The upper tube (41) and the lower tube (42) are hollow and co-axially connected. The inner diameters of the upper tube (41) and the lower tube (42) respectively match those of the middle cylindrical portions (202) and the lowest cylindrical portions (203) of the inner housing (20) so as to respectively sleeve the middle cylindrical portions (202) and the lowest cylindrical portions (203) therein. The lower tube (42) has at least one first fastening part formed on a periphery of the lower tube (42). Each of the at least one first fastening part may be a pin (43) protruding upwardly from a periphery of the lower tube (42).

The lamp cover module (50) has a lamp cover (51), an opening (52), a neck (53) and at least one second fastening part. The lamp cover (51) is hollow. The opening (53) is formed through a top of the lamp cover (50). The neck (51) is formed to extend upwardly from the opening (52). An inner diameter and an outer diameter of the neck (51) respectively match an outer diameter of the lower tube (42) of the lower shell (40) and an inner diameter of the outer housing (10). The neck (51) has a second fastening part (54) matching the first fastening part. Each of the second fastening part (54) may be an L-shaped slot (52) formed through the neck (51) and extending downwardly from a top edge of the neck to an intermediate stop and further transversely extending from the intermediate stop to an end point, and can be fastened with the pin (43) of the lower shell (40). Alternatively, the first and second fastening parts may be respectively implemented by the L-shaped slot (52) formed on the lower tube (42) of the lower shell (40) and the pin (43) formed on an inner wall of the neck (51) of the lamp cover module (50).

Figure 3:
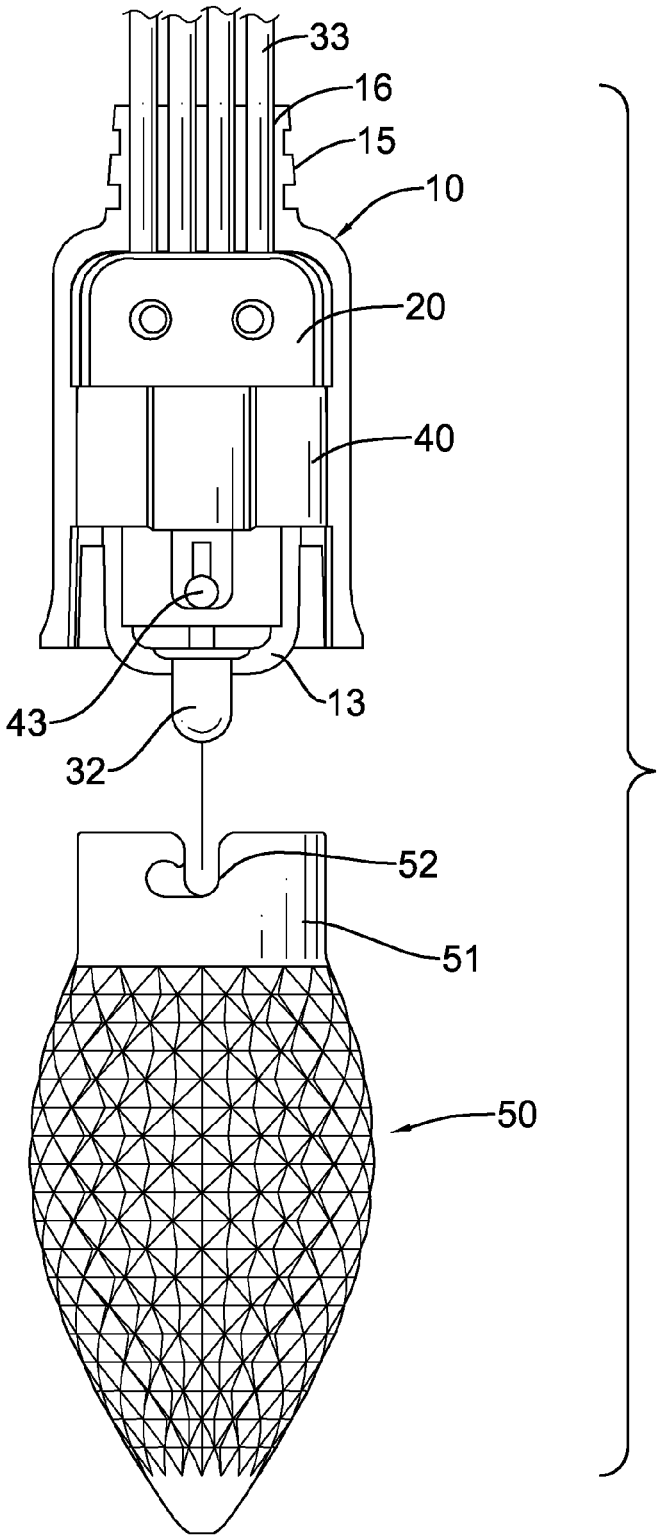
FIG. 3 is a partially exploded front view of the lamp assembly in FIG. 1.
Figure 4:
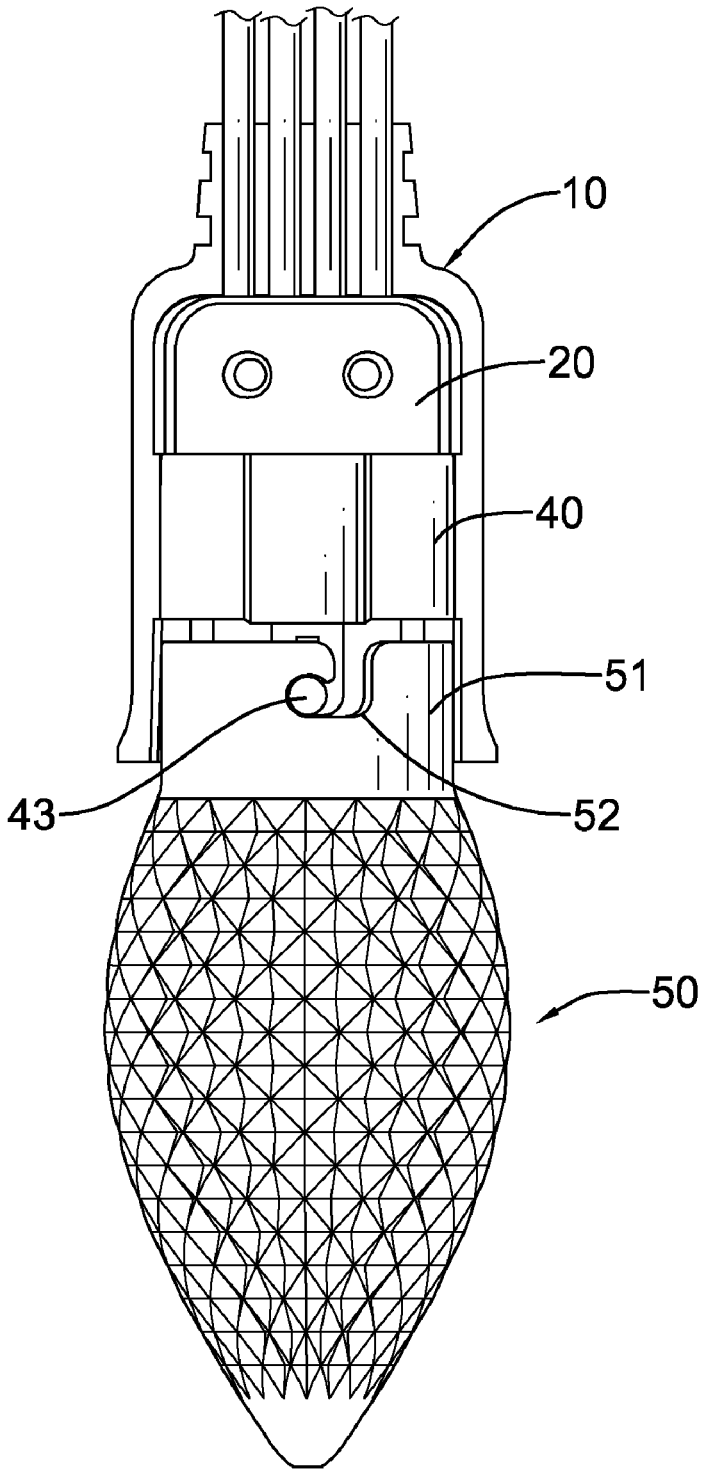
FIG. 4 is a front view of the lamp assembly in FIG. 1.

With reference to FIGS. 3 and 4, the detailed assembly procedure is described as follows:

The lamp module (30) is first mounted between the two assembled inner cases (21, 22) of the inner housing (20). The LED bulb (32) and the set of power lines (33) of the lamp module (30) respectively penetrate through the bottom and the top of the inner housing (20). The middle cylindrical portions (202) and the lowest cylindrical portions (203) of the inner housing (20) are respectively sleeved by the upper tube (41) and the lower tube (42) of the lower shell (40) to further seal the two inner cases (21, 22). The inner housing (20) is assembled within the two outer cases (11, 12) of the outer housing (10). The lamp cover module (50) is inserted into a bottom of the outer housing (10), and the L-shaped slot (52) on the neck (51) of the lamp cover module (50) is fastened with the pin (43) on the lower shell (40) by aligning the L-shaped slot (52) on the neck (51) of the lamp cover module (50) with the pin (43) on the lower shell (40) and continuing pushing the pin (43) downwardly into the neck (50) until the pin (43) reaches the intermediate stop of the L-shaped slot (52). Next, the lamp cover module (50) is transversely turned to move the pin (43) to the end point of the L-shaped slot (52) so as to finish assembling the lamp cover module (50) to the lower shell (40).

Figure 5:
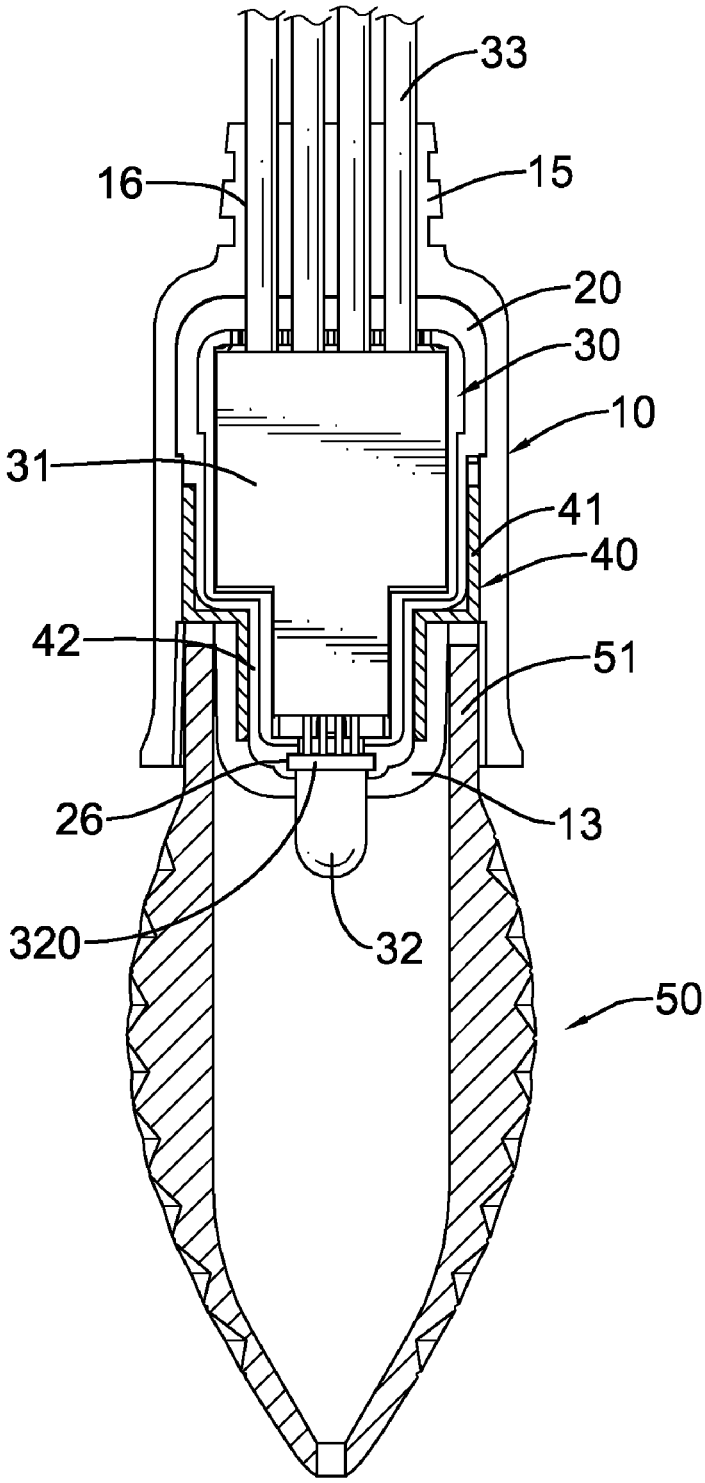
FIG. 5 is a cross-sectional view of the lamp assembly in FIG. 1.

With reference to FIG. 5, the circuit board of the lamp module (30) being prone to environmental influence is covered and doubly protected by the inner housing (20) and the outer housing (10). Since the LED bulb has good weathering resistance, it is unnecessary for the LED bulb to be further covered.

Figure 6:
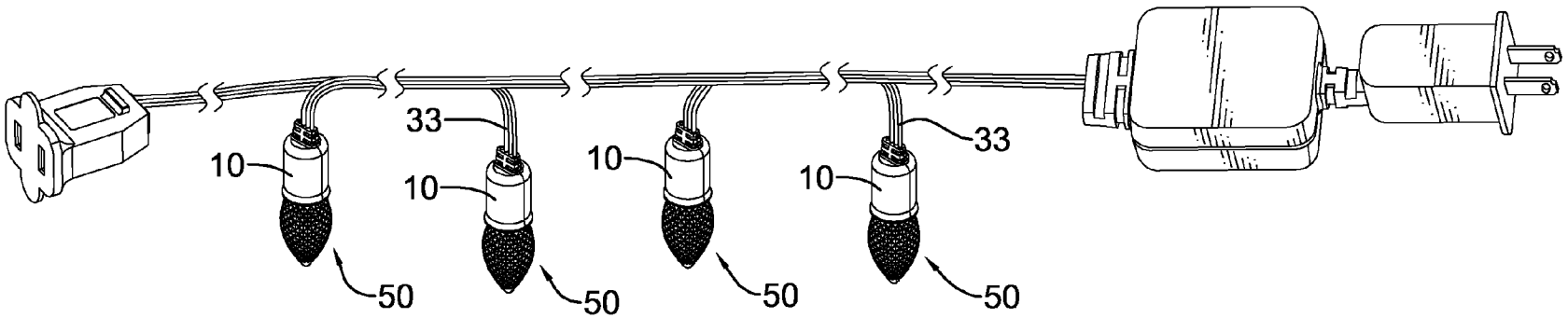
FIG. 6 is a perspective view of a string light having multiple lamp assemblies in accordance with the present invention.

With reference to FIG. 6, a set of string light having the lamp assemblies connected in a row is shown. The portion of the set of string light exposed outdoors pertains to nothing but the lamp assembly and the connection cable. The connection cable is sheathed for durable outdoor application. Accordingly, the weathering capability of the lamp assembly is important in preventing moisture and dust.

Covered by the inner housing, the outer housing and the lower shell and sealed by the guard ring, the circuit board of the lamp assembly, which is vulnerable to moisture and dust, is thoroughly protected against adverse weather condition. The engagement portions formed on the inner housing, multi-step cylinder formed on the lower shell and the at least one first and second fastening parts further enhance the sealing capability of the lamp assembly. Besides, without requiring any tool the lamp assembly can be easily and conveniently assembled manually with engagement means including the wall and the recess of the inner housing and the fastening means including the L-shaped slot of the lamp cover module and the pin of the lower tube of the lower shell.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A lamp assembly of LED string light, comprising:

an outer housing being hollow and having:

an inner wall;

two outer cases being symmetrical and correspondingly assembled; and two half bottom portions being symmetrical and correspondingly assembled, each of the two half bottom portions formed on a lower portion of the inner wall;

an inner housing mounted inside the outer housing, being hollow, taking a form of a multi-step cylinder and having:

two inner cases being symmetrical and correspondingly assembled, each of the two inner cases having:

an engagement portion formed on an inside border of the corresponding inner case; and three half cylindrical portions sequentially and downwardly formed on a periphery of each of the inner cases with the respective diameters decreasing downwardly and the lowest half cylindrical portion received in the half bottom portion of the corresponding outer case;

a lamp module mounted inside the inner housing and having a circuit board, an LED bulb formed on a lower end of the circuit board and penetrating through a bottom of the inner housing and a bottom of the two outer cases;

a connection circuit formed on the circuit board to electronically connect with the LED bulb; and a set of power lines connected with the connection circuit and sequentially penetrating through the inner housing and the outer housing;

a lower shell having:

an upper tube being hollow and having an inner diameter matching an outer diameter of the middle half cylindrical portions of the inner housing to sleeve the middle half cylindrical portions therein; and a lower tube being hollow and co-axially connected with the upper tube, and having an inner diameter matching an outer diameter of the lowest half cylindrical portions of the inner housing to sleeve the lowest cylindrical portions therein and at least one first fastening part formed on a periphery of the lower tube; and a lamp cover module being hollow and having:

a lamp cover;

an opening formed through a top of the lamp cover;

a neck formed to extend upwardly from the opening, and having an inner diameter and an outer diameter respectively matching an outer diameter of the lower tube of the lower shell and an inner diameter of the outer housing; and at least one second fastening part formed on the neck, each of the at least one second fastening part engaging with the corresponding first fastening part.

2. The lamp assembly as claimed in claim 1, wherein the outer housing takes a form of a bell;

two recesses are respectively formed between a periphery of the half bottom portion and the inner wall of the outer case, and the half bottom portion takes a bowl-shaped form and has a half first lamp hole formed through a bottom of the half bowl for the LED bulb to penetrate through.

3. The lamp assembly as claimed in claim 2, wherein each of the two outer cases has a half outlet portion extending upwardly from an inside portion of a top of each of the outer cases, and has multiple wire channels formed in an inner wall of the half outlet portion for the set of power lines of the lamp module to penetrate through.

4. The lamp assembly as claimed in claim 3, wherein the engagement portions of the two inner cases of the inner housing are a wall formed along the inside border of one of the two inner cases and a groove formed in the inside border of the other inner case and are mutually engaged.

5. The lamp assembly as claimed in claim 4, wherein each of the two inner cases has:

multiple wire channels formed in a top portion of an inner wall of each of the inner cases for the set of power lines to penetrate through;

a half second lamp hole formed through a bottom inside the inner case; and a half guard ring formed on a bottom outside the inner case and underneath the half second lamp hole.

6. The lamp assembly as claimed in claim 5, wherein the circuit board takes a T-like form to suit for a space enclosed by the inner cases; and the LED bulb penetrates through the second lamp hole of the inner cases and has an annular loop formed on the LED bulb and engaging in the two half guard rings of the inner cases.

7. The lamp assembly as claimed in claim 6, wherein the first fastening part is a pin formed on and protruding upwardly from a periphery of the lower case; and the second fastening part is an L-shaped slot formed through the neck and extending downwardly from a top edge of the neck.

8. The lamp assembly as claimed in claim 6, wherein the first fastening part is an L-shaped slot formed through a periphery of the lower case; and the second fastening part is a pin formed on and protruding upwardly from the neck.

* * * * *